US012172095B2

(12) United States Patent
Forgrave et al.

(10) Patent No.: US 12,172,095 B2
(45) Date of Patent: Dec. 24, 2024

(54) MARBLE RUN TRAMPOLINE MODULE AND KIT

(71) Applicant: Pike Brands LLC, Seattle, WA (US)

(72) Inventors: Jeffrey David Forgrave, Indianapolis, IN (US); Chong Piu Wong, Kowloon Bay (HK)

(73) Assignee: Pike Brands LLC, Seattle, WA (US)

( * ) Notice: Subject to any disclaimer, the term of this patent is extended or adjusted under 35 U.S.C. 154(b) by 244 days.

(21) Appl. No.: 17/970,979

(22) Filed: Oct. 21, 2022

(65) Prior Publication Data

US 2024/0131443 A1 Apr. 25, 2024
US 2024/0226763 A9 Jul. 11, 2024

(51) Int. Cl.

| | |
|---|---|
| ***A63H 18/00*** | (2006.01) |
| ***A63F 7/36*** | (2006.01) |
| ***A63H 18/02*** | (2006.01) |
| ***A63H 33/00*** | (2006.01) |

(52) U.S. Cl.
CPC ..... *A63H 18/028* (2013.01); *A63F 7/3622* (2013.01); *A63H 18/00* (2013.01); *A63H 33/00* (2013.01)

(58) Field of Classification Search
CPC ..... A63H 18/00; A63H 18/02; A63H 33/00; A63F 7/02; A63F 7/025; A63F 7/3622
See application file for complete search history.

(56) References Cited

U.S. PATENT DOCUMENTS

| | | | | |
|---|---|---|---|---|
| 3,300,891 | A * | 1/1967 | Glass | A63F 7/3622 273/276 |
| 3,818,628 | A * | 6/1974 | Ensmann | A63H 33/3044 273/342 |
| 4,171,090 | A * | 10/1979 | Eisenburg | A63F 7/3622 238/10 R |
| 4,932,917 | A * | 6/1990 | Klitsner | A63F 7/3622 446/168 |
| 5,312,285 | A * | 5/1994 | Rieber | A63F 7/3622 273/109 |
| 5,785,573 | A * | 7/1998 | Rothbarth | A63F 7/3622 446/171 |
| 7,862,789 | B2 * | 1/2011 | Gatton, Jr. | B01D 53/83 422/171 |
| 10,850,205 | B2 * | 12/2020 | Forgrave | A63H 33/22 |
| 2018/0236350 | A1 * | 8/2018 | Johnston | A63H 18/02 |

* cited by examiner

*Primary Examiner* — John A Ricci
(74) *Attorney, Agent, or Firm* — Maginot, Moore & Beck, LLP

(57) ABSTRACT

A trampoline module for use with a plurality of physically interconnectable marble run modules includes a connecting boss, a concave shell, and a resilient head. The connecting boss is configured to connect to a corresponding connector on at least one of the physically interconnectable marble run modules, and defines a connection direction. The concave shell is arranged at least in part above the connecting boss, and includes a perimeter rim. The resilient head is affixed to the concave shell and over the perimeter rim, such that the resilient head defines a first planar surface. The first planar surface defines a first plane having a first direction perpendicular to the first plane, wherein the first direction and the connection direction are non-parallel.

20 Claims, 6 Drawing Sheets

MARBLE RUN TRAMPOLINE MODULE AND KIT

FIELD OF THE INVENTION

The present invention is related to building toys, and more specifically, kits for designing and building marble run tracks.

BACKGROUND

Marble run toys known in the art have interconnecting track sections that may be arranged by a user in any of a plurality of designs. Once constructed, the track can define a downhill track through the various sections or modules. The interchangeable nature of the various modules allows for the construction of a large variety of unique marble run layouts.

FIG. 1 shows an exemplary marble run layout 10 formed of a plurality of interconnecting modules 11A, 11B, 11C, 11D, 11E, 11F and 18. The modules may take many forms, such as modules 11A, 11B and 11C, which include channels 12 that laterally direct a marble from a vertical receiving tube 14 to an exit tube 16. The channels 12 may define circuitous routes, such as those of modules 11B and 11C. Other modules are merely vertical tubes 18 that can be used as part of the marble route, or merely as vertical support structures for other modules. Still other modules 11D can include a wide platform 20 with spikes 22 to direct the ball in an unpredictable path from the vertical receiving tube 24 and the exit tube 26. Other modules 11E can include a bowl structure. Still other modules having additional or alternative features are also known.

In popular marble run kits, the vertical receiving tube 14 of each module is generally designed to directly physically connect to an exit tube 16 of an upstream module, thus allowing the marble to transition from module to module. In FIG. 1, most of the receiving tubes 14 are coupled to, and therefore disposed within, part of the exit tube 16 of an upstream module, and therefore are not in view. The modules may have other tubes or structures 28 under the vertical receiving tube 14 to allow that portion of the module to be supported from below, for example, by vertical tube modules 18. Similarly, some modules may have a bypass tube 30 disposed vertically above the exit tube 16 that may provide support as well as an alternative input.

In this embodiment, a common connection scheme is employed in which the tops of the various modules (e.g. 11A, 11B, 11C, 11D and 18) include one or more connection bosses 31 that are configured to tightly fit within a bottom opening 33 of various other modules, which serves as another connection boss. In this embodiment, the connection bosses 31 are round structures that are wide enough to receive a marble therethrough, but define an outer diameter that is slightly less or about the same as the inner diameter of the bottom opening 33 of the various modules 11A, 11B, 11C, 11D and 18. It will be appreciated that many or all of the vertical receiving tubes 14 and bypass tubes 30 include a connection boss similar to the connection bosses 31, and every exit tube 16 includes a bottom opening similar to the bottom opening 33. Accordingly, each intersection of two modules shown in FIG. 1 includes a connection boss similar to the connection boss 31 of a lower module disposed within a bottom opening similar to the bottom opening 33 of a module disposed above it.

Like many construction toys, the marble run kits currently available allow for creative play by enabling the user to construct the marble run (or multiple runs) in a multitude of configurations. Unlike many construction toys, however, the marble run kits have the added advantage providing animated feedback of the player's design via movement of the marble. Accordingly, marble run kits have enjoyed pervasive success.

It would be desirable, nevertheless, to create a toy kit that builds on the advantages of the marble run kits with additional features including those with travel variations that can involve experimentation and evaluation.

SUMMARY

The embodiments described herein provide a trampoline module that is capable of propelling or bouncing a marble through the air after impact, and in some embodiments, to a target module that is connected to feed the marble to any of a plurality of conventional marble run modules.

A first embodiment is a trampoline module for use with a plurality of physically interconnectable marble run modules. Each of the physically connectable marble run modules is configured to retain a marble and guide the travel of the marble through the module on at least a first surface. The trampoline run module includes a connecting boss, a concave shell, and a resilient head. The connecting boss is configured to connect to a corresponding connector on at least one of the physically interconnectable marble run modules, and connects in a connection direction. The concave shell is arranged at least in part above the connecting boss, and has a perimeter rim. The resilient head is affixed to the concave shell and is disposed over the perimeter rim. The resilient head defines a first planar surface having a first direction perpendicular. The first direction and the connection direction are non-parallel.

A second embodiment is trampoline set having a trampoline module and a catching module that can be used with a plurality of physically interconnectable marble run modules. The trampoline module includes a first connecting boss configured to connect to a first corresponding connector on at least one of the physically interconnectable marble run modules, a concave shell arranged at least in part above the first connecting boss, the concave shell having a perimeter rim, and a resilient head affixed to the concave shell and over the perimeter rim. The catching module includes a catching module having a bowl body having an upper opening configured to receive an airborne marble.

The above-described features and advantages, as well as others, will become more readily apparent to those of ordinary skill in the art by reference to the following detailed description and accompanying drawings.

DETAILED DESCRIPTION

Figure 2:
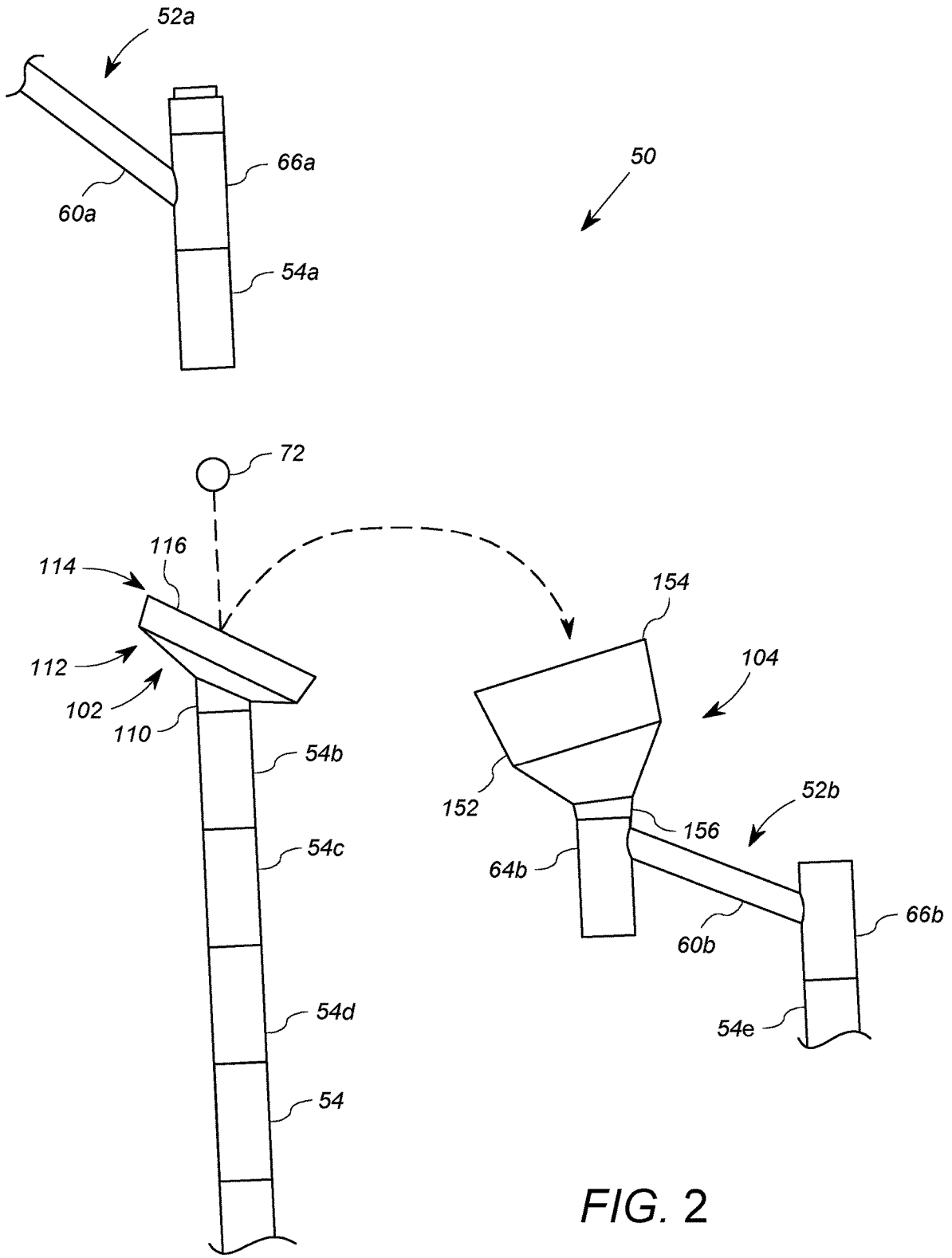
FIG. 2 shows a fragmentary side plan view of a marble run that incorporates a trampoline set according to a first embodiment.

FIG. 2 shows a fragmentary side plan view of a marble run 50 that incorporates a trampoline set 100 according to a first embodiment of the invention. The marble run 50 includes a number of conventional elements from the traditional marble run kits. In this example, the visible portion of the marble run 50 includes two ramp modules 52*a*, 52*b*, a plurality of vertical spacer modules 54*a*, 54*b*, 54*c*, 54*d*, 54*e* and so forth, and the trampoline set 100, which includes a trampoline module 102 and a catching module 104.

Figure 1:
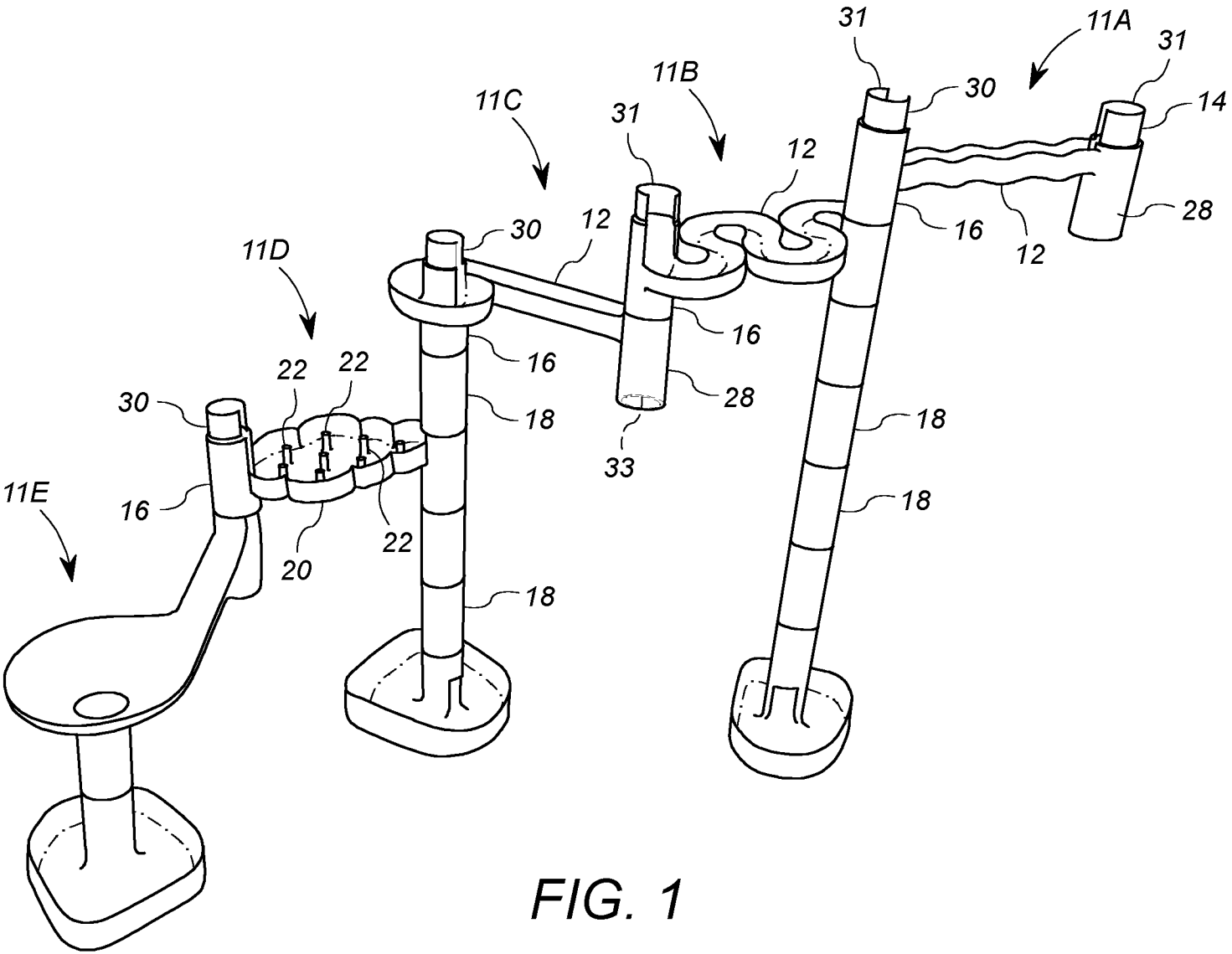
FIG. 1 shows a perspective view of an exemplary marble run layout formed of a plurality of interconnecting prior art modules.

The ramp module 52*a* has the general structure of the modules 11A, 11B and 11C of FIG. 1, and has a marble channel 60*a* that laterally directs a marble from an interconnecting vertical receiving tube, not shown in FIG. 2, to an exit tube 66*a*. The ramp module 52*b* has the same structure, and as shown in FIG. 1, has a marble channel 60*b* that laterally directs a marble from an interconnecting vertical receiving tube 64*b* to an exit tube 66*b*. The vertical receiving tube 64*b* of the ramp module 52*b* is generally designed to directly physically connect to an exit tube of an upstream module such as the exit tube 16 of the modules 11A, 11B, and 11C, for example, of FIG. 1. These connections allow the marble to transition from module to module. To this end, the vertical receiving tube 64*b* of the module 52*b* includes a connecting boss, not visible in FIG. 2, but which may suitably have the same structure as the connection boss 31 of FIG. 1.

The vertical spacing modules 54*a*, 54*b*, 54*c* and so forth have the general structure of the vertical tubes 18 of FIG. 1. Accordingly, each vertical spacing module 54*a*, 54*b*, 54*c* and so forth can connect to the vertical receiving tube 64*b* (from above) or an exit tube 66*a*, 66*b* (from below), of the ramp modules 52*a*, 52*b*, and preferably any of the modules 11A through 11F of FIG. 1. The vertical spacing modules 54*a*, 54*b*, 54*c* and so forth can also connect to each other from above or below, as is known in the art. The vertical spacing modules 54*a*, 54*b*, 54*c* and so forth allow for vertical travel of the marble therethrough, but may also be used for vertical support of other modules.

The trampoline module 102 is configured for use with a plurality of physically interconnectable marble run modules such as those of the marble run 10 of FIG. 1, and the modules 52*a*, 52*b*, 54*a*, etc. of FIG. 2. To this end, the trampoline module 102 includes a connecting boss 110 configured to connect to a corresponding connector of any of a plurality of other interconnectable marble run modules. In this embodiment, for example, the connecting boss 110 is configured to connect to receive the connecting boss 31 of FIG. 1, or any shape that creates a tight fit in the connecting boss 110. The connecting boss 110 may suitably have the same structure as the connecting boss 33 of FIG. 1.

The trampoline module 102 further includes a concave shell 112 arranged at least in part above the first connecting boss 110. The concave shell 112 includes a perimeter rim 114 (not visible in FIG. 2, but see FIGS. 5, 6, discussed further below). The trampoline module 102 further includes a resilient head 116 affixed to the concave shell 112 and over the perimeter rim 114. Further detail regarding an exemplary embodiment of the trampoline module 102 is provided further below in connection with FIGS. 3 through 6.

The catching module 104 includes a bowl body 152 having an upper opening 154 configured to receive an airborne marble. In this embodiment, the catching module 104 also includes a connecting boss 156 that is configured to connect to a corresponding connector of any of a plurality of other interconnectable marble run modules. The connecting boss 156 may suitably have a bottom opening having the structure of the connecting boss 33 of FIG. 1.

It will be appreciated that the exemplary marble run 50 of FIG. 2 is provided only to illustrate the operation of the trampoline set 100 in the context, and like various marble run modules, the trampoline set 100 may be used in connection with nearly infinite variations of the marble run 50.

In the exemplary marble run 50, the top of a first vertical spacing module 54*a* is coupled to the exit tube 66*a* of a first ramp module 52*a*, so that a marble traveling across the marble channel 60*a* exits through the exit tube 66*a*, and into the first vertical spacing module 54*a*. The trampoline module 102 is disposed below (but not connected to) the vertical spacing module 54*a* such that a marble exiting the bottom of the vertical spacing module 54*a* will strike the resilient head 116. The trampoline module 102 is supported from below by a stack of vertical spacing modules 54*b*, 54*c*, 54*d*, etc. In particular, the connecting boss 110 of the trampoline module 102 is coupled to the top of the vertical spacing module 54*b*, the bottom of the vertical spacing module 54*b* is coupled to the top of the vertical spacing module 54*c*, and so forth.

As with the prior art marble run 10, all of the connections in the marble run 50 are in the vertical direction, meaning that the connection direction between modules is perpendicular to the ground or other horizontal surface on which the marble run 10 and marble run 50 are supported. Accordingly, the connecting boss 110 of the trampoline modules couples to the top of the vertical spacing module 54*b* in the vertical connection direction. As will be discussed below, the concave shell 112, connecting boss 110 and perimeter rim 114 are configured to support the resilient head 116 such as to define a plane at an inclined angle with respect to the horizontal direction (or not perpendicular to the connection direction). As a result, a marble striking the resilient head 116 from above will bounce both upward and laterally. Furthermore, the trampoline module is designed such that the lateral component sufficient to clear the perimeter rim 114 at reasonable marble drop heights, including for example, twelve inches.

The catching module 104 in this embodiment is disposed laterally spaced apart from the trampoline module 102 and at a vertical level below the highest level of the perimeter rim 114 of the trampoline module 102. To this end, the connecting boss 156 of the catching module 104 is coupled to the vertical receiving tube 64*b* of the second ramp module 52*b*. The exit tube 66*b* of the second ramp module 52*b* is coupled to the top of another vertical spacing module 54*e*.

In use of the portion of the marble run 50 shown in FIG. 2, a marble (e.g. marble 72) travels down the marble channel 60*a* of the first ramp module 52*a*, and exits through the exit tube 66*a*. The marble 72 thereafter falls through the first vertical spacing module 54*a* and toward the trampoline module 102. The falling marble 72 strikes the resilient head 116, and the resiliency of the head 116 causes the marble 72 to bounce. The inclined orientation of the striking surface of the head 116 causes the marble 72 to travel through the air upward and laterally toward the catching module 104. Gravity causes the airborne travel of the marble 72 to arc into the upper opening 154, and the design of the bowl 152 reduces the probability of the marble bouncing back out of the bowl 152.

In this embodiment, the connecting boss 156 is hollow and has an opening for receiving the marble from the bowl 152. The marble 72 therefore falls through the connecting boss 156 and into the receiving tube 64*b* of the second ramp module 52*b*. The marble 72 may then roll down the marble channel 60*b* toward the exit tube 66*b*, where it can then fall into the spacing tube 54*e*. The marble 72 can then fall through the spacing tube 54*e* into and through any other modules, not shown.

Figure 4:
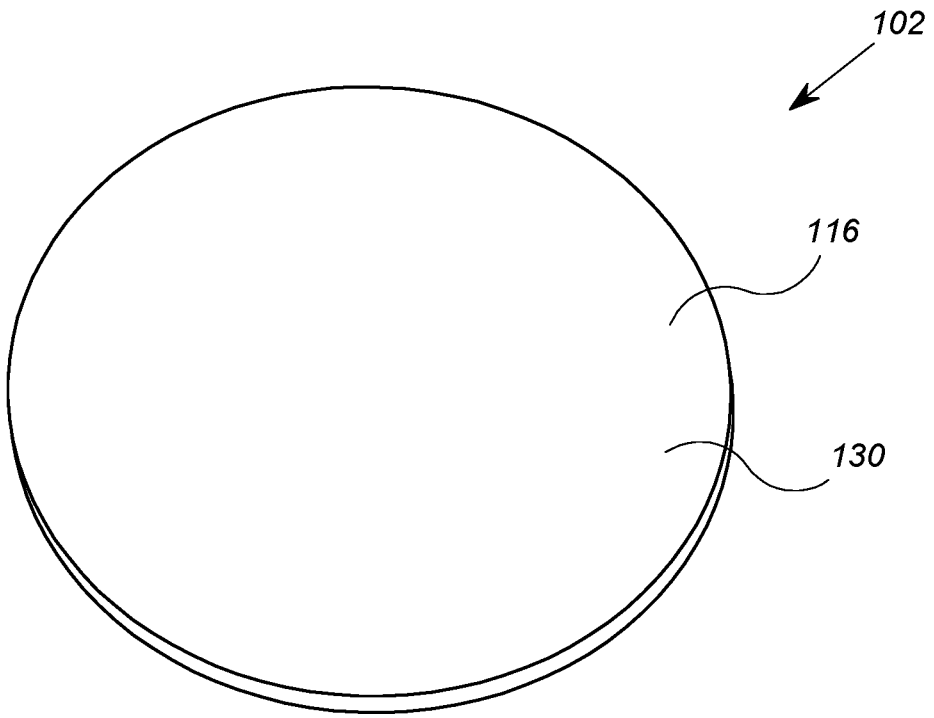
FIG. 4 shows a top perspective view of the trampoline module of FIG. 3.
Figure 3:
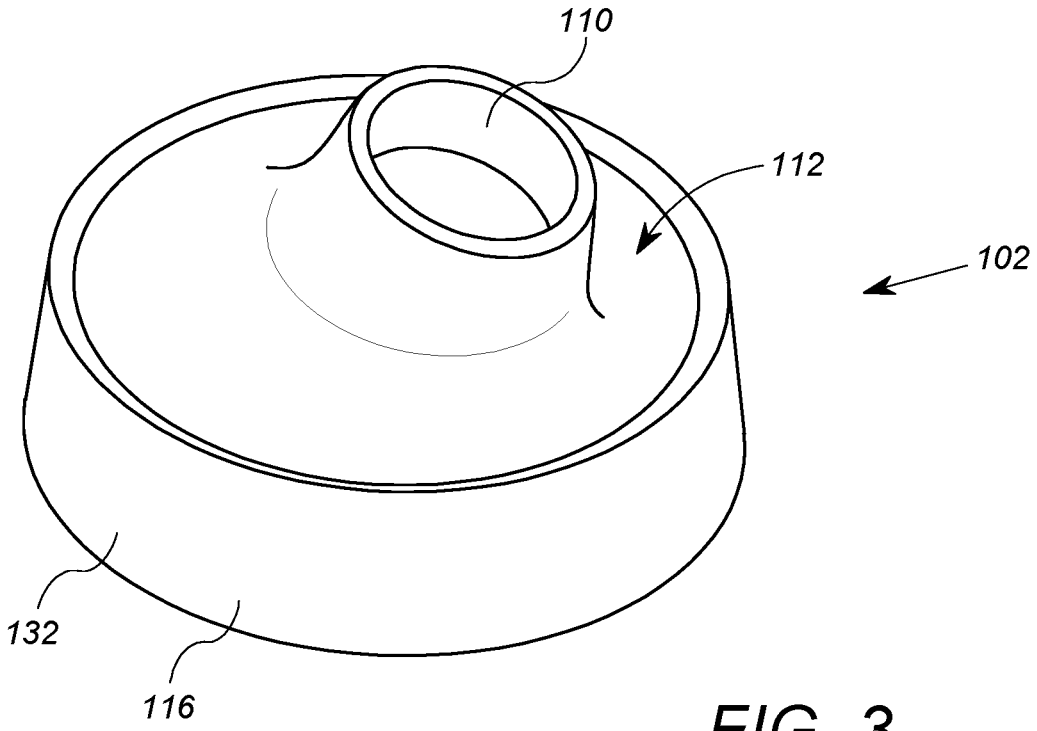
FIG. 3 shows a bottom perspective view of the trampoline module of the trampoline set of FIG. 2.
Figure 5:
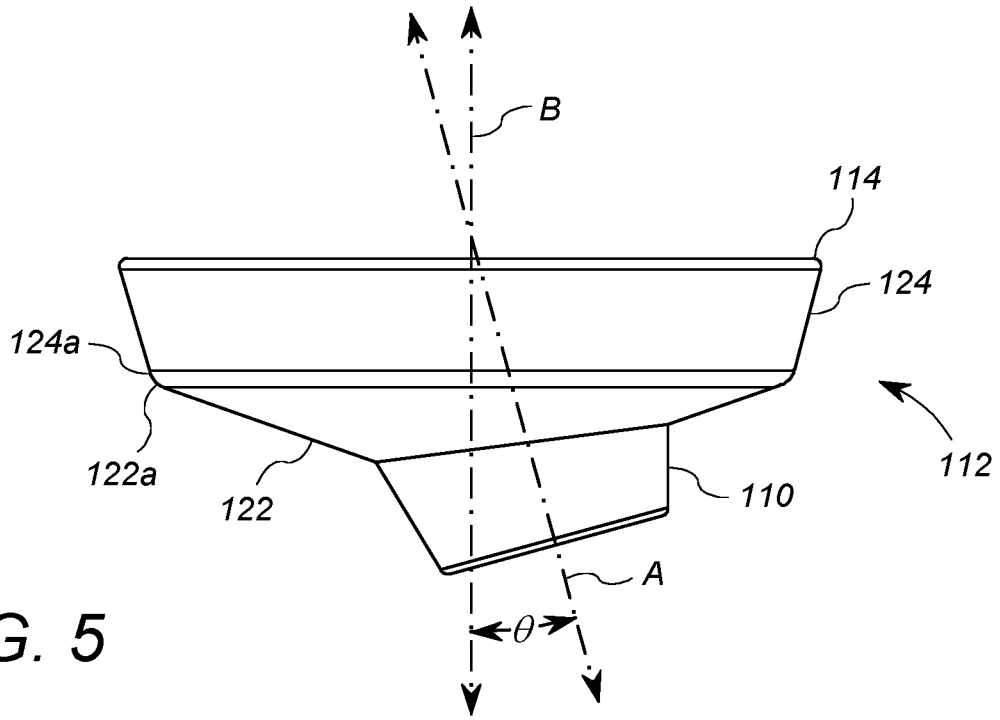
FIG. 5 shows a side plan view of the concave shell and connecting boss of the trampoline module of FIG. 3.
Figure 6:
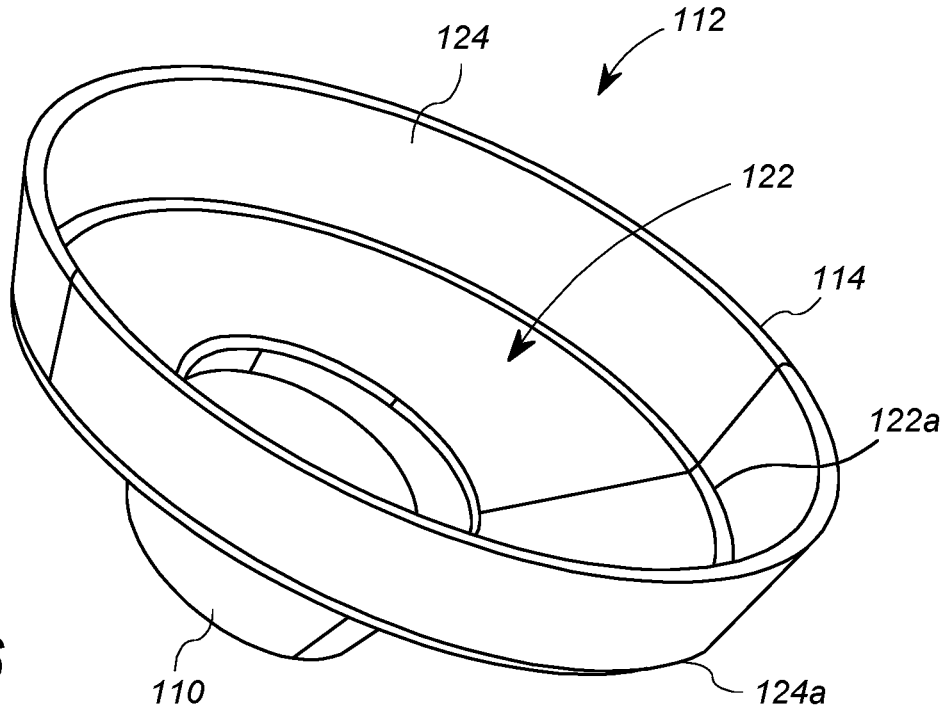
FIG. 6 shows a top perspective view of the concave shell and connecting boss of the trampoline module of FIG. 3.

The details of an exemplary trampoline module 102 are discussed below in connection with FIGS. 3, 4, 5, and 6. FIG. 3 shows a bottom perspective view of the trampoline module 102, FIG. 4 shows a top perspective view of the trampoline module 102, FIG. 5 shows a side plan view of the concave shell 112 and connecting boss 110 of the trampoline module 102, and FIG. 6 shows a top perspective view of the concave shell 112 and connecting boss 110.

With contemporaneous reference to FIGS. 3, 4, 5 and 6, the trampoline module 102 includes the connecting boss 110, the concave shell 112, and resilient head 116 affixed thereto to the concave shell 112. The concave shell 112 and the connecting boss 110 may suitable be formed of a single piece of plastic. The concave shell 112 is generally hollow and includes a bowl portion 122 and upper flange portion 124. With specific reference to FIG. 5, the bowl portion 122 extends frustoconically (but axially askew) from the connecting boss 110 to a top rim 122*a*. The top rim 122*a* has a diameter or width that is at least twice that of the connecting boss 110. The upper flange portion 124 extends axially and frustoconically from the top rim 122*a* of the bowl portion 122, which also forms a lower annular edge 124*a* of the upper flange portion 124, to the perimeter rim 114.

The frustoconical design of the bowl portion 122 and the upper flange portion 124 generally create a top that is much wider than the connecting boss 110. Accordingly, it will be appreciated that the shape of either of or both of the bowl portion 122 and the upper flange portion 124 need not be frustoconical in other designs, so long as they have a generally concave shape such that the perimeter rim 114 has a width or diameter that is at least twice as wide as the connection boss 110.

In this embodiment, each of the perimeter rim 114 and lower annular edge 124*a* are substantially circular, with the lower annular edge 124 having a smaller diameter than the perimeter rim 114. The use of a circular perimeter rim 114 facilitates ease of assembly the resilient head 116 to the concave shell 112, as will be discussed below in detail. In this embodiment, ease of assembly is also facilitate by the fact that the resilient heat 116 is configured to fit over the perimeter rim 114 like a cap, as opposed to using an internal connection. Moreover, the use of the resilience as both as the elastic surface and as a method of retaining the resilient head 116 to the concave shell 112 eliminates the need for other fastening elements or adhesives, or at least reinforces the retention of those embodiments that use fastening elements or adhesives.

The resilient head 116 includes a planar striking surface 130 and a connecting sleeve or rim 132. The planar striking surface 130 has an outer perimeter 134 that is extends around and engages the perimeter rim 114 of the concave shell 112. The connecting rim 132 extends downward from the outer perimeter 134 and has a shape and size that is complementary to the upper flange portion 124 of the concave shell 112. Thus, in this embodiment, the connecting rim 132 extends frustoconically downward and inward from the outer perimeter 134. The connecting rim 132 tightly fits about the upper flange portion 124 to create tautness in the planar striking surface 130. It will be appreciated that if the perimeter rim 114 has a different shape, such as an oval shape or polyhedron shape, the resilient head 116 would be configured to have a similarly shaped outer perimeter 134, and would be configured to tightly fit on the upper flange portion 124, whatever the shape. However, it will further be appreciated that the use of a circular perimeter rim 114 and conical upper flange portion 124 allows for ease of manufacturing because it does not require any particular annular alignment for assembly of the resilient head 116 on upper flange portion 124.

As discussed above, the connection boss 110 is configured to connect to a corresponding connector of a corresponding marble run module, such as a male connecting boss (e.g. connecting boss 31 of FIG. 1) of another module. With reference to FIG. 5, the connection boss 110 in this embodiment is a tubular member defining an axis A, which is the connection direction of the trampoline module 102. The axis A of the connection boss 110 is askew of an axis of the concave shell 112. In particular, the concave shell 112 defines an axis B that is normal to the plane defined by the planar striking surface 130 of the resilient head 116 (and/or the plane in which the perimeter rim 114 sits). The axis A is preferably at an angle θ with respect to the axis B. The value of 0 is preferably between 15 degrees and 45 degrees, but in any event sufficient to ensure that a marble bouncing off of the planar striking surface from eight or so inches bounces sufficiently vertically and laterally to clear the perimeter rim 114.

It will be appreciated that the connection boss 110 may take other forms, in which case the connection boss 110 and concave shell 112 should be designed such that vertical orientation of the connection boss 110 with respect to a reference surface, not shown, will result in the plane of the planar striking surface 130 to be approximately at an angle θ with respect to the reference surface. The reference surface, for example, would be a horizontal surface such as a floor or table upon which the marble run 50 is disposed.

The trampoline module 102 is thus designed such that when connected to an underlying vertical module or marble run module such as those shown in FIG. 1, it presents a taut resilient surface 130 that is configured to elastically deform when struck by a vertically falling marble, and then recover its form, thereby propelling the marble away from the surface 130. The marble is propelled such that its initial flight has a vertical component and a lateral component. The vertical component changes due to gravity, and the marble preferably clears the perimeter rim 114 before falling below the lowest level of the perimeter rim 114, as illustrated in FIG. 2.

Figure 7:
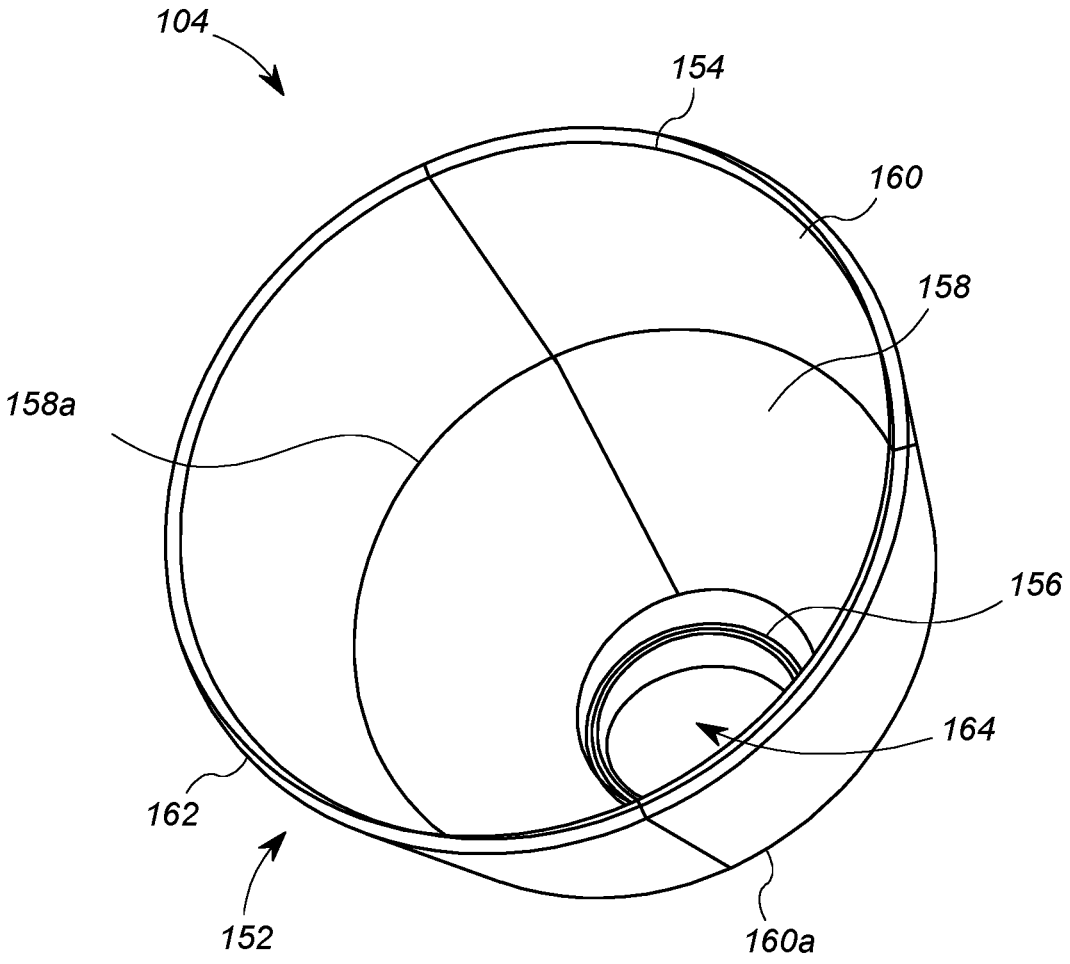
FIG. 7 shows a top perspective view of the catching module of the trampoline set of FIG. 2.

In an advantageous embodiment, such as that illustrated in FIG. 2, the trampoline module 102 is provided with the catching module 104. The catching module 104 is configured to receive a flying marble, such as one propelled by the trampoline module 102, and to either retain the marble, or direct it to an exit tube. FIG. 7 shows a top perspective view of the catching module 104, FIG. 8 shows a side plan view of the catching module 104, and FIG. 9 shows a bottom perspective view of the catching module 104.

Figure 8:
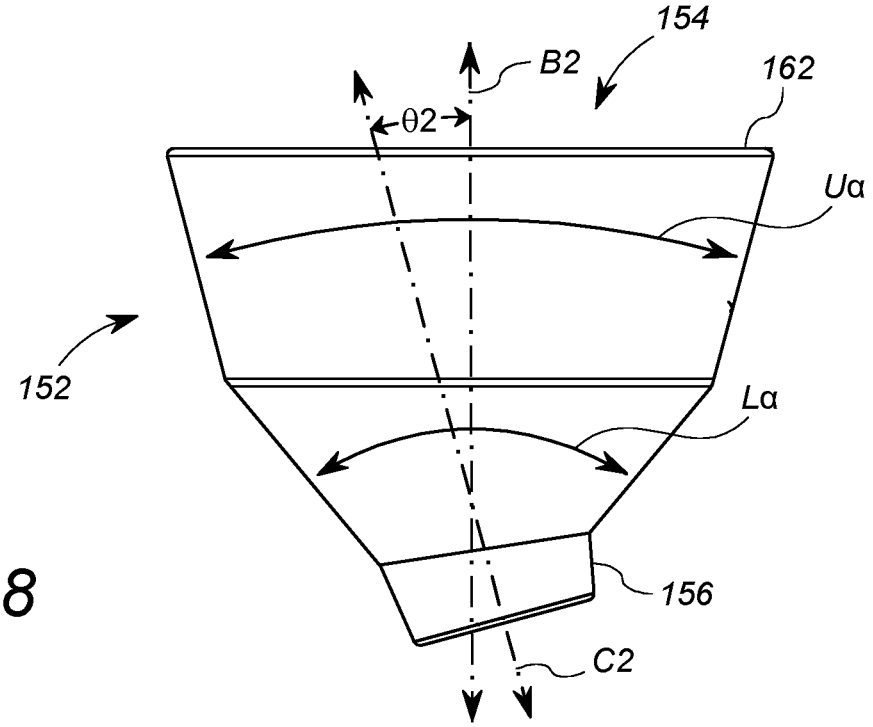
FIG. 8 shows a side plan view of the catching module of FIG. 7.
Figure 9:
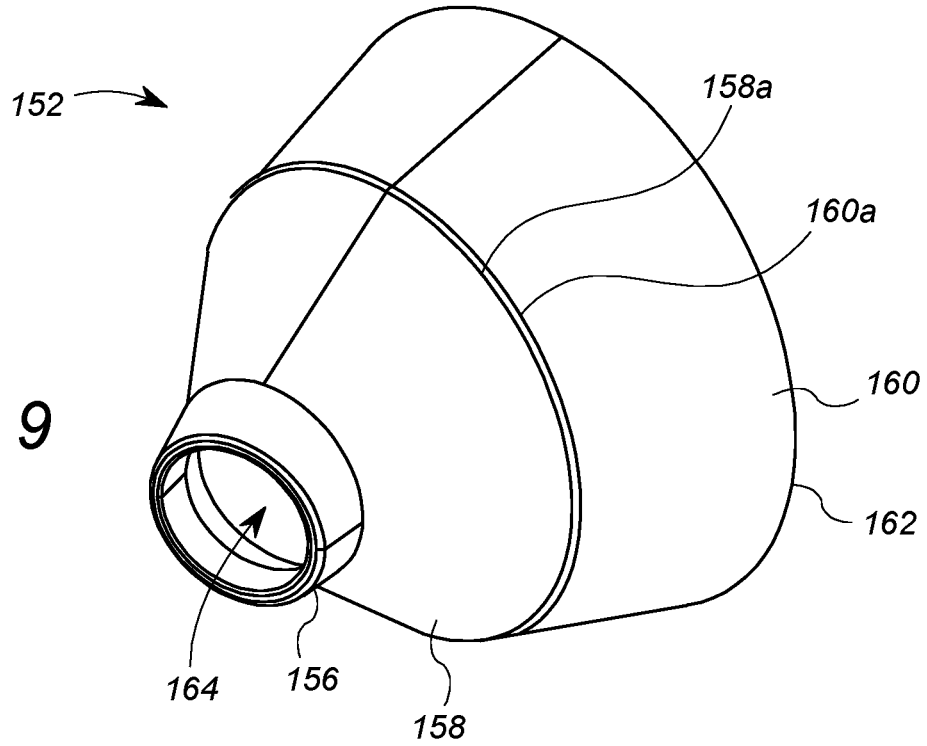
FIG. 9 shows a bottom perspective view of the catching module of FIG. 7.

With contemporaneous reference to FIGS. 7, 8 and 9, and as discussed above in connection with FIG. 2, the catching module 104 includes the bowl body 152 having an upper opening 154 configured to receive an airborne marble. In this embodiment, the catching module 104 also includes the connecting boss 156 that is configured to connect to a corresponding connector of any of a plurality of other interconnectable marble run modules.

The bowl body 152 and the connecting boss 156 may suitable be formed of a single piece of plastic. The bowl body 152 is generally hollow and includes a lower bowl portion 158 and upper bowl 160. The lower bowl 158 extends frustoconically (but axially askew) from the connecting boss 156 to a top rim 158*a*. The top rim 158*a* has a diameter or width that is at least twice (and preferably at least three times) that of the connecting boss 156. The upper bowl 160 extends axially and frustoconically from the top rim 158*a* of the lower bowl portion 158, which also forms a lower annular edge 160*a* of the upper bowl 160, to an uppermost perimeter rim 162, which defines the opening 154.

With particular reference to FIG. 8, the conical shape of the frustoconical lower bowl 158 defines an apex angle Lα that is greater than an apex angle Uα of the conical shape of the frustoconical upper bowl 160. In other words, the upper bowl 160 has steeper side walls (or conical wall) than the lower bowl 158. Such design helps inhibit a flying marble received through the opening 154 from bouncing back out through the opening 154. When the marble strikes the interior walls of the upper bowl 160, the marble will be directed downward into the lower bowl 158 and/or through the opening 164 between the lower bowl 158 and the connecting boss 156. While it is possible that the entire bowl 152 could have the apex angle of the upper bowl 160, the resulting structure would require excess height to achieve the same radius of the opening 154 and the same radius of the connecting boss 156. The design of having at least two bowl sections with different apex angles helps retain a received marble without requiring the module 104 to have excessive height.

It will also be appreciated that part or all of the bowl 152 may alternatively be in the form of an elliptical or spherical dome, or other dome shape (e.g. geodesic dome, etc.), wherein the lower portion nearer the connecting boss 156 has shallower walls, on average, then the upper portion nearer the perimeter rim 162.

In any event, the frustoconical design of the lower bowl 158 and the upper bowl 160 generally create a top that is much wider than the connecting boss 110. Accordingly, it will be appreciated that the shape of either of or both of the upper bowl 160 and lower bowl 158 need not be frustoconical in other designs, so long as they have a generally concave shape such that the perimeter rim 162 has a width or diameter that is at least twice as wide as the connection boss 156. For example, the bowl 152 may also take the form of other tubes having converging walls. However, it will be appreciated that the combination of steep walls nearer the perimeter rim 162 and shallower walls near the connecting boss 156 provides the above-stated advantage of marble retention and reduced height.

As discussed above, the connection boss 156 is configured to connect to a corresponding connector of a corresponding marble run module, such as a male connecting boss of another module. Thus, the connection boss 156 in this embodiment is a tubular member defining an axis C2, which is the connection direction used in modules 10, 50, by way of example. The axis C2 of the connection boss 110 is askew of an axis of the at least the upper bowl 160, which may suitably be coaxial with the lower bowl 158. In this embodiment, the upper bowl 160 defines an axis B2 that is normal to the plane defined by the rim 162. However, it is will be appreciated that the axis B2 may be instead be defined by as the central axis through the conical shape of the upper bowl 160, if plane of the perimeter rim 162 is not strictly perpendicular to the axis in another embodiment. The axis C2 is preferably at an angle θ2 with respect to the axis B2. The value of 0 is preferably between 10 degrees and 40 degrees, but in any event sufficient to ensure that a marble traveling in vertically and laterally will be retained and directed to the opening 164 between the lower bowl 158 and the connecting boss 156.

It will be appreciated that the connection boss 156 may take other forms, in which case the connection boss 156 and bowl 158 should be designed such that vertical orientation of the connection boss 156 with respect to a reference surface, not shown, will result in the axis of the upper bowl 160 be at an angle of 90—θ with respect to the reference surface.

The result of the design of the trampoline module 102 and the catching module 104 in this embodiment is that a marble (e.g. marble 72 of FIG. 2) to bounce from a vertical drop of at least 6 inches upward from the resilient head 116 and laterally, and such that the travel of the marble after bouncing passes through the opening 154 of the catching module 104. The catching module 104 is further configured to avoid a marble received in such manner from bouncing off of the interior walls and back out through the opening 154. It will be appreciated that the trampoline module 102 may be used without any catching module, or with catching modules having a completely different configuration.

It will be appreciated that the above-described embodiments are merely exemplary, and that those of ordinary skill in the art may readily devise their own implementations or modifications that incorporate the principles of the present invention and fall within the spirit and scope thereof.

The invention claimed is:

1. A trampoline module for use with a plurality of physically interconnectable marble run modules, each module configured to retain a marble and guide the travel of the marble through the module on at least a first surface, the trampoline module comprising:

a connecting boss configured to connect to a corresponding connector on at least one of the physically interconnectable marble run modules, the connecting boss defining a connection direction;

a concave shell arranged at least in part above the connecting boss, the concave shell having a perimeter rim;

a resilient head affixed to the concave shell and over the perimeter rim, such that the resilient head defines a first planar surface, the first planar surface defining a first plane having a first direction perpendicular to the first plane, wherein the first direction and the connection direction are non-parallel.

2. The trampoline module of claim 1, wherein the resilient head has an elasticity and the concave shell is configured such that when a toy marble is dropped on first location on the resilient head, the toy marble bounces upward and away from the first location to clear the perimeter rim in the air.

3. The trampoline module of claim 1, wherein the perimeter rim has a first diameter, and wherein the first diameter is at least two times a diameter or width defined by the connecting boss.

4. The trampoline module of claim 1, wherein an angle between the connection direction and the first direction is between 10 degrees and 40 degrees.

5. The trampoline module of claim 1, wherein the connecting boss comprises a hollow tube having an interior, and is configured to receive in the interior a connecting element of the corresponding connector on the at least one of the physically interconnectable marble run modules.

6. The trampoline module of claim 1, wherein a specific stiffness of the concave shell is at least about an order of magnitude greater than a specific stiffness of the resilient head.

7. The trampoline module of claim 1, wherein the concave shell includes a bowl portion and an upper flange portion, the upper flange portion extending axially from a lower annular edge to the perimeter rim, wherein the lower annular edge defines a cross-sectional area that is less than a cross-sectional area defined by the perimeter rim.

8. The trampoline module of claim 7, wherein each of the perimeter rim and lower annular edge are substantially circular.

9. The trampoline module of claim 1, wherein the resilient head includes a planar striking surface and a connecting rim, the connecting rim configured to extend over the perimeter rim and extending downward outward and against a surface of the concave shell.

10. The trampoline module of claim 9, wherein the connecting rim extends downward outward of and against an outer surface of the concave shell.

11. The trampoline module of claim 9 wherein the connecting rim extends frustoconically downward and inward from the outer perimeter.

12. A trampoline set comprising:

a trampoline module for use with a plurality of physically interconnectable marble run modules, each module configured to retain a marble and guide the travel of the marble through the module on at least a first surface, the trampoline module comprising, a first connecting boss configured to connect to a first corresponding connector on at least one of the physically interconnectable marble run modules, a concave shell arranged at least in part above the first connecting boss, the concave shell having a perimeter rim, and a resilient head affixed to the concave shell and over the perimeter rim; and a catching module comprising, a catching module comprising a bowl body having an upper opening configured to receive an airborne marble.

13. The trampoline set of claim 12, wherein the catching module further includes a second connecting boss configured to connect to a second corresponding connector on at least one of the physically interconnectable marble run modules.

14. The trampoline module of claim 13, wherein the resilient head includes a planar striking surface and a connecting rim, the connecting rim configured to extend over the perimeter rim and extending downward outward and against a surface of the concave shell.

15. The trampoline module of claim 14, wherein the connecting rim extends frustoconically downward and inward from the outer perimeter.

16. The trampoline set of claim 13, wherein the second connecting boss includes a hollow tube having a first end forming an open passage to an interior of the bowl body and a second end forming a marble exit.

17. The trampoline set of claim 12, wherein the bowl body includes at least a first section and a second section, and when the bowl body is situated such that the upper opening is facing substantially upward, the first section has a first angle of inclination with respect to horizontal, and the second section has a second angle of inclination with respect to horizontal, the first angle greater than the second angle, and wherein the second section is disposed below the first section.

18. The trampoline module of claim 17, wherein the resilient head includes a planar striking surface and a connecting rim, the connecting rim configured to extend over the perimeter rim and extending downward outward and against a surface of the concave shell.

19. The trampoline module of claim 18, wherein the connecting rim extends downward outward of and against an outer surface of the concave shell.

20. The trampoline module of claim 18, wherein the connecting rim extends frustoconically downward and inward from the outer perimeter.

* * * * *